US005992724A

United States Patent [19]

Snyder

[11] Patent Number: 5,992,724

[45] Date of Patent: Nov. 30, 1999

[54] STAPLER WITH STAPLE QUANTITY INDICATOR

[76] Inventor: Thomas W. Snyder, P.O. Box 363, Lake Havasu, Ariz. 86405

[21] Appl. No.: 09/244,402

[22] Filed: Feb. 4, 1999

[51] Int. Cl.[6] ..... B25C 1/04

[52] U.S. Cl. ..... 227/120; 227/134; 227/156

[58] Field of Search ..... 227/120, 2, 3, 227/156, 134

[56] References Cited

U.S. PATENT DOCUMENTS

| | | | |
|---|---|---|---|
| 5,427,298 | 6/1995 | Tegtmeier | 227/120 |
| 5,441,191 | 8/1995 | Linden | 227/120 |
| 5,503,320 | 4/1996 | Webster et al. | 227/19 |
| 5,507,425 | 4/1996 | Ziglioli | 227/120 |
| 5,782,397 | 7/1998 | Koukline | 227/120 |

*Primary Examiner*—Scott A. Smith

[57] ABSTRACT

A stapler with staple quantity indicator for notifying a user when only a predetermined amount of staples are left in a stapler. The stapler with staple quantity indicator includes a base, a cover pivotally coupled to the base, and a guide track pivotally coupled to the base and positioned between the cover and the base. The guide track is adapted for receiving staples therein. The guide track has opposite front and rear ends. The rear end is pivotally coupled to the base. A sliding block is slidably disposed in the guide track for pushing the staples towards the front end of the guide track. The sliding block is biased towards the front end of the guide track. A quantity indicating system detects when less than a predetermined amount of staples are left in the guide track. The quantity indicating system comprises an indicator light and a power source in electrical communication with the indicator light. The indicator light emits visible light when less than a predetermined amount of staples remain in the guide track.

16 Claims, 2 Drawing Sheets

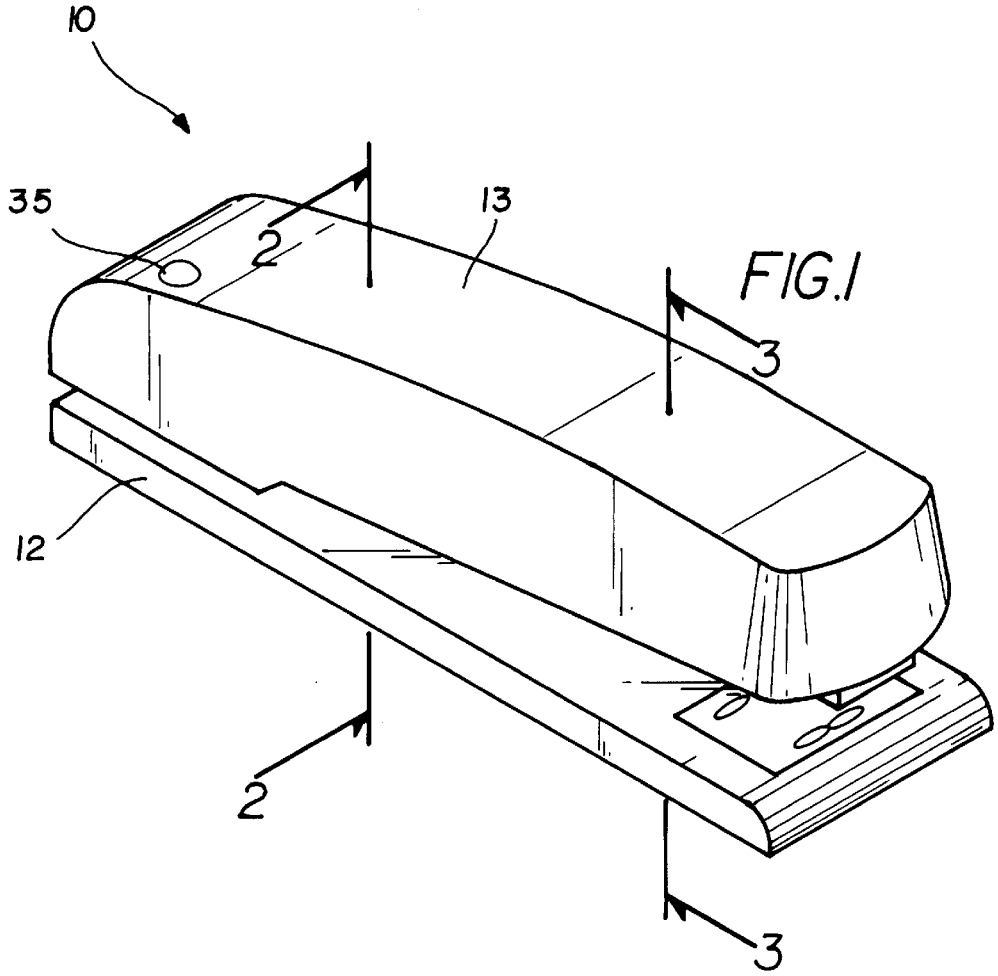
FIG.1
FIG.2
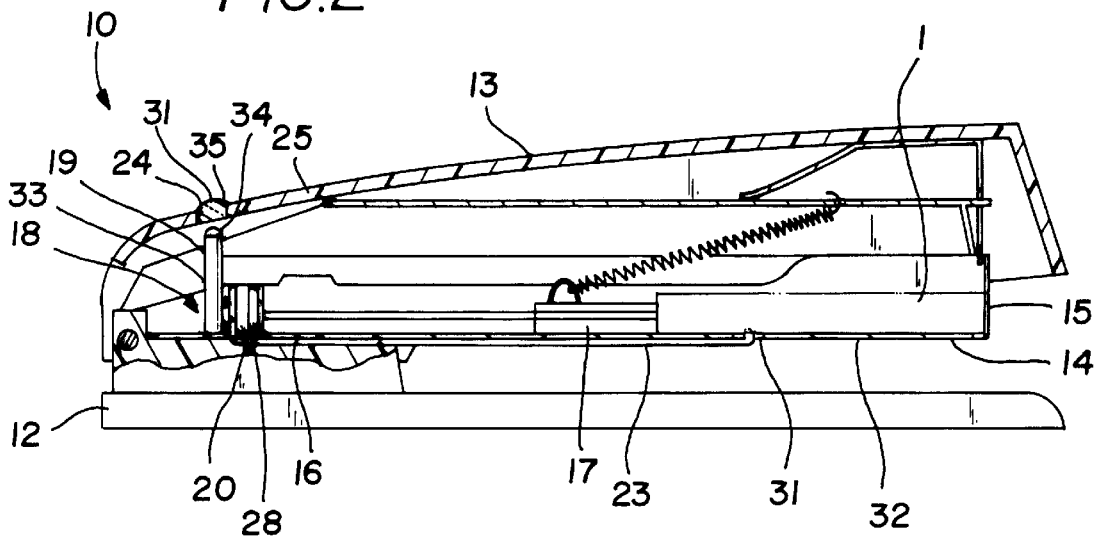

FIG.3
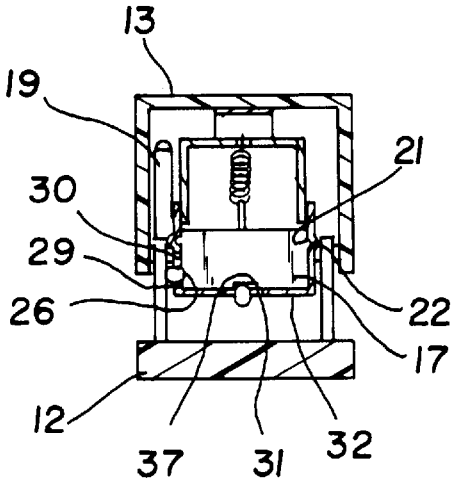
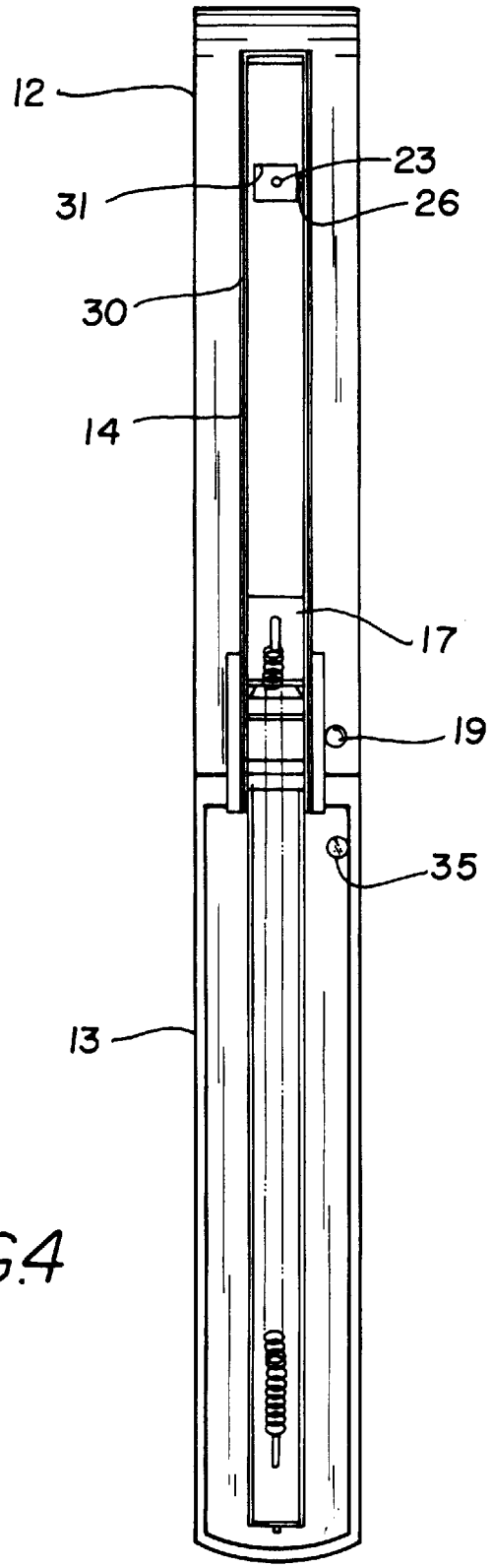
FIG.4

STAPLER WITH STAPLE QUANTITY INDICATOR

BACKGROUND OF THE INVENTION

1. Field of the Invention

The present invention relates to staplers and more particularly pertains to a new stapler with staple quantity indicator for notifying a user when only a predetermined amount of staples are left in a stapler.

2. Description of the Prior Art

The use of staplers is known in the prior art. More specifically, staplers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,386,725; U.S. Pat. No. 5,441,191; U.S. Pat. No. 4,506,819; U.S. Pat. No. 2,973,519; U.S. Pat. No. 2,227,826; and U.S. Pat. No. Des. 361,025.

While these devices fulfill their respective, particular objectives and requirements, the aforementioned patents do not disclose a new stapler with staple quantity indicator. The inventive device includes a base, a cover pivotally coupled to the base, and a guide track pivotally coupled to the base and positioned between the cover and the base. The guide track is adapted for receiving staples therein. The guide track has opposite front and rear ends. The rear end is pivotally coupled to the base. A sliding block is slidably disposed in the guide track for pushing the staples towards the front end of the guide track. The sliding block is biased towards the front end of the guide track. A quantity indicating system detects when less than a predetermined amount of staples are left in the guide track. The quantity indicating system comprises an indicator light and a power source in electrical communication with the indicator light. The indicator light emits visible light when less than a predetermined amount of staples remain in the guide track.

In these respects, the stapler with staple quantity indicator according to the present invention substantially departs from the conventional concepts and designs of the prior art, and in so doing provides an apparatus primarily developed for the purpose of notifying a user when only a predetermined amount of staples are left in a stapler.

SUMMARY OF THE INVENTION

In view of the foregoing disadvantages inherent in the known types of staplers now present in the prior art, the present invention provides a new stapler with staple quantity indicator construction wherein the same can be utilized for notifying a user when only a predetermined amount of staples are left in a stapler.

The general purpose of the present invention, which will be described subsequently in greater detail, is to provide a new stapler with staple quantity indicator apparatus and method which has many of the advantages of the staplers mentioned heretofore and many novel features that result in a new stapler with staple quantity indicator which is not anticipated, rendered obvious, suggested, or even implied by any of the prior art staplers, either alone or in any combination thereof.

To attain this, the present invention generally comprises a base, a cover pivotally coupled to the base, and a guide track pivotally coupled to the base and positioned between the cover and the base. The guide track is adapted for receiving staples therein. The guide track has opposite front and rear ends. The rear end is pivotally coupled to the base. A sliding block is slidably disposed in the guide track for pushing the staples towards the front end of the guide track. The sliding block is biased towards the front end of the guide track. A quantity indicating system detects when less than a predetermined amount of staples are left in the guide track. The quantity indicating system comprises an indicator light and a power source in electrical communication with the indicator light. The indicator light emits visible light when less than a predetermined amount of staples remain in the guide track.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new stapler with staple quantity indicator apparatus and method which has many of the advantages of the staplers mentioned heretofore and many novel features that result in a new stapler with staple quantity indicator which is not anticipated, rendered obvious, suggested, or even implied by any of the prior art staplers, either alone or in any combination thereof.

It is another object of the present invention to provide a new stapler with staple quantity indicator which may be easily and efficiently manufactured and marketed.

It is a further object of the present invention to provide a new stapler with staple quantity indicator which is of a durable and reliable construction.

An even further object of the present invention is to provide a new stapler with staple quantity indicator which is susceptible of a low cost of manufacture with regard to both materials and labor, and which accordingly is then susceptible of low prices of sale to the consuming public, thereby making such stapler with staple quantity indicator economically available to the buying public.

Still yet another object of the present invention is to provide a new stapler with staple quantity indicator which provides in the apparatuses and methods of the prior art some of the advantages thereof, while simultaneously overcoming some of the disadvantages normally associated therewith.

Still another object of the present invention is to provide a new stapler with staple quantity indicator for notifying a user when only a predetermined amount of staples are left in a stapler.

Yet another object of the present invention is to provide a new stapler with staple quantity indicator which includes a base, a cover pivotally coupled to the base, and a guide track pivotally coupled to the base and positioned between the cover and the base. The guide track is adapted for receiving staples therein. The guide track has opposite front and rear ends. The rear end is pivotally coupled to the base. A sliding block is slidably disposed in the guide track for pushing the staples towards the front end of the guide track. The sliding block is biased towards the front end of the guide track. A quantity indicating system detects when less than a predetermined amount of staples are left in the guide track. The quantity indicating system comprises an indicator light and a power source in electrical communication with the indicator light. The indicator light emits visible light when less than a predetermined amount of staples remain in the guide track.

Still yet another object of the present invention is to provide a new stapler with staple quantity indicator that eliminates the need to open a stapler to check the supply of staples.

Even still another object of the present invention is to provide a new stapler with staple quantity indicator that ends the frustration of suddenly running out of staples.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a new stapler with staple quantity indicator according to the present invention.

FIG. 2 is a schematic cross sectional view of the present invention.

FIG. 3 is a schematic cross sectional view of the present invention.

FIG. 4 is a schematic side view of the present invention in an open configuration.

DESCRIPTION OF THE PREFERRED EMBODIMENT

With reference now to the drawings, and in particular to FIGS. 1 through 4 thereof, a new stapler with staple quantity indicator embodying the principles and concepts of the present invention and generally designated by the reference numeral 10 will be described.

As best illustrated in FIGS. 1 through 4, the stapler with staple quantity indicator 10 generally comprises a base 12, a cover 13 pivotally coupled to the base, and a guide track 14 pivotally coupled to the base and positioned between the cover and the base. The guide track is adapted for receiving staples 1 therein. The guide track has opposite front and rear ends 15,16. The rear end is pivotally coupled to the base. A sliding block 17 is slidably disposed in the guide track for pushing the staples towards the front end of the guide track. The sliding block is biased towards the front end of the guide track. A quantity indicating system 18 detects when less than a predetermined amount of staples are left in the guide track. The quantity indicating system comprises an indicator light 19 and a power source 20 in electrical communication with the indicator light. The indicator light emits visible light when less than a predetermined amount of staples remain in the guide track.

Preferably, each of the side panels of the guide track has a groove 21 extending along it. The sliding block has a pair of tongues 22 extending into the grooves to hold the sliding block in the guide track to ensure that contact is not lost between the sliding block and the first sensor wire 23, as will be discussed below.

Also preferably, the cover has an aperture 24 through an upper panel 25 thereof.

Preferably, the quantity indicating system comprises first and second sensor wires 23,26, an indicator light in electrical communication with the first (or second) sensor wire and positioned towards the aperture of the cover when the cover is in a closed orientation, and a power source, such as a battery 28 or solar panel (not shown), that is in electrical communication with the indicator light and the second (or first) sensor wire. The indicator light may extend through the aperture of the cover, or it may rest below the aperture.

As seen in FIG. 3, the second sensor wire extending into the guide track through an aperture 29 of a side panel 30 of the guide track. The second sensor wire contacting the staples resting in the guide track.

Ideally, the first sensor wire extends into the guide track through an aperture 31 of a bottom panel 32 of the guide track. The first sensor wire contacts the sliding block when less than a predetermined amount of staples remain in the guide track between the sliding block and the front end of the guide track thereby forming a circuit created by the sensor wires, power source, and indicator light and lighting the indicator light. This way, the battery is only used when the staples are low.

Alternatively, the power source could be electrically connected to the guide track, which would act in place of the second sensor wire, though use of the second sensor wire is preferable as it helps prevent accidentally closing the circuit and illuminating the indicator light.

The indicator light may flash at predetermined intervals when less than a predetermined amount of staples remain in the guide track. The flashing light would be more apt to draw a user's attention to the stapler.

Preferably, the indicator light comprises an elongate cylindrical housing 33 that is coupled to the guide track and a bulb 34 positioned towards an upper opening of the housing. The housing positions the bulb towards the aperture of the cover. Optionally, the housing may have a square shaped transverse cross section, though round is preferred since the upper rim of a cylindrical housing forms a better seal with a round bulb to prevent debris from settling in the housing.

Optionally, an indicator light lens 35 is disposed in the aperture of the cover for protecting the indicator light from damage. Ideally, in such an embodiment, the indicator light lens has a protruding rounded upper tip 36 for permitting visual reception of the light emitted by the indicator light from any position above a plane extending tangentially across an upper surface of the upper panel of the cover. Optionally, the indicator light lens may magnify the light emitted by the indicator light.

Preferably, the sliding block has a notch 37 in a lower surface thereof adapted for receiving the first sensor wire. The notch helps position the first sensor wire away from a perimeter of the aperture of the bottom panel of the guide track to help prevent short circuits which could occur if an uninsulated portion the first sensor wire came in contact with the guide track.

In use, the cover is pivoted away from the guide track and staples are loaded into the guide track. The cover is closed. The cover is pressed towards the base to staple objects together. When less than a predetermined amount of staples remain in the guide track, the indicator light emits visible light to notify a user that the quantity of staples remaining are less than the predetermined amount.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stapler, comprising:

a base;

a cover being pivotally coupled to said base;

a guide track being pivotally coupled to said base and being positioned between said cover and said base, said guide track being adapted for receiving staples therein;

said guide track having opposite front and rear ends, said rear end being pivotally coupled to said base;

a sliding block being slidably disposed in said guide track for pushing said staples towards said front end of said guide track, said sliding block being biased towards said front end of said guide track;

a quantity indicating system for detecting when less than a predetermined amount of staples are left in said guide track;

said quantity indicating system comprising an indicator light and a power source being in electrical communication with said indicator light;

said indicator light emitting visible light when less than a predetermined amount of staples remain in said guide track; and wherein said quantity indicating system comprises a first sensor wire in electrical communication with said indicator light, said first sensor wire extending into said guide track through an aperture of a bottom panel of said guide track, said power source being in electrical communication with said guide track, said first sensor wire contacting said sliding block when less than a predetermined amount of staples remain in said guide track thereby forming a circuit and lighting said indicator light.

2. The stapler of claim 1, wherein said cover has an aperture through an upper panel thereof, said indicator light being positioned towards said aperture of said cover when said cover is in a closed orientation.

3. The stapler of claim 2, wherein said indicator light comprising an elongate housing being coupled to said guide track and a bulb positioned towards an upper opening of said cylindrical housing, said housing being for positioning said bulb towards said aperture of said cover.

4. The stapler of claim 2, further comprising an indicator light lens being disposed in said aperture of said cover for protecting said indicator light from damage.

5. The stapler of claim 4 , wherein said indicator light lens has a protruding rounded upper tip for permitting visual reception of the light emitted by said indicator light from any position above a plane extending tangentially across an upper surface of said upper panel of said cover.

6. The stapler of claim 4, wherein said indicator light lens magnifies the light emitted by said indicator light.

7. The stapler of claim 1, wherein said indicator light flashes at predetermined intervals when less than a predetermined amount of staples remain in said guide track.

8. The stapler of claim 1, wherein said sliding block has a notch in a lower surface thereof adapted for receiving said first sensor wire, said notch being for helping position said first sensor wire away from a perimeter of said aperture of said bottom panel of said guide track to help prevent short circuits which could occur if an uninsulated portion the first sensor wire came in contact with the guide track.

9. A stapler, comprising:

a base;

a cover being pivotally coupled to said base;

a guide track being pivotally coupled to said base and being positioned between said cover and said base, said guide track being adapted for receiving staples therein;

said guide track having opposite front and rear ends, said rear end being pivotally coupled to said base;

a sliding block being slidably disposed in said guide track for pushing said staples towards said front end of said guide track, said sliding block being biased towards said front end of said guide track;

a quantity indicating system for detecting when less than a predetermined amount of staples are left in said guide track;

said quantity indicating system comprising an indicator light and a power source being in electrical communication with said indicator light;

said indicator light emitting visible light when less than a predetermined amount of staples remain in said guide track; and wherein said quantity indicating system comprises first and second sensor wires, said first sensor wire being in electrical communication with said indicator light, said first sensor wire extending into said guide track through an aperture of a bottom panel of said guide track, said power source being in electrical communication with said second sensor wire, said second sensor wire extending into said guide track and contacting said staples resting in said guide track, said first sensor wire contacting said sliding block when less than a predetermined amount of staples remain in said guide track thereby forming a circuit and lighting said indicator light.

10. The stapler of claim 9, wherein said cover has an aperture through an upper panel thereof, said indicator light being positioned towards said aperture of said cover when said cover is in a closed orientation.

11. The stapler of claim 10, wherein said indicator light comprising an elongate housing being coupled to said guide track and a bulb positioned towards an upper opening of said cylindrical housing, said housing being for positioning said bulb towards said aperture of said cover.

12. The stapler of claim 10, further comprising an indicator light lens being disposed in said aperture of said cover for protecting said indicator light from damage.

13. The stapler of claim 12, wherein said indicator light lens has a protruding rounded upper tip for permitting visual reception of the light emitted by said indicator light from any position above a plane extending tangentially across an upper surface of said upper panel of said cover.

14. The stapler of claim, 12, wherein said indicator light lens magnifies the light emitted by said indicator light.

15. The stapler of claim 9, wherein said indicator light flashes at predetermined intervals when less than a predetermined amount of staples remain in said guide track.

16. A stapler, comprising:

a base;

a cover being pivotally coupled to said base, said cover having an aperture through an upper panel thereof;

a guide track being pivotally coupled to said base and being positioned between said cover and said base, said guide track being adapted for receiving staples therein;

said guide track having opposite front and rear ends, said rear end being pivotally coupled to said base;

a sliding block being slidably disposed in said guide track for pushing said staples towards said front end of said guide track, said sliding block being biased towards said front end of said guide track;

side panels of said guide track each having a groove extending therealong, said sliding block having a pair of tongues extending into said grooves to hold said sliding block in said guide track;

a quantity indicating system for detecting when less than a predetermined amount of staples are left in said guide track;

said quantity indicating system comprising first and second sensor wires, an indicator light being in electrical communication with said first sensor wire and being positioned towards said aperture of said cover when said cover is in a closed orientation, and a power source, such as a battery or solar panel, being in electrical communication with said indicator light and said second sensor wire;

said indicator light emitting visible light when less than a predetermined amount of staples remain in said guide track;

said second sensor wire extending into said guide track through an aperture of a side panel of said guide track, said second sensor wire contacting said staples resting in said guide track;

said first sensor wire extending into said guide track through an aperture of a bottom panel of said guide track, said first sensor wire contacting said sliding block when less than a predetermined amount of staples remain in said guide track thereby forming a circuit and lighting said indicator light;

wherein said indicator light flashes at predetermined intervals when less than a predetermined amount of staples remain in said guide track;

said indicator light comprising an elongate cylindrical housing being coupled to said guide track and a bulb positioned towards an upper opening of said cylindrical housing, said cylindrical housing being for positioning said bulb towards said aperture of said cover;

an indicator light lens being disposed in said aperture of said cover for protecting said indicator light from damage;

said indicator light lens having a protruding rounded upper tip for permitting visual reception of the light emitted by said indicator light from any position above a plane extending tangentially across an upper surface of said upper panel of said cover;

said indicator light lens magnifying the light emitted by said indicator light;

said sliding block having a notch in a lower surface thereof adapted for receiving said first sensor wire, said notch being for helping position said first sensor wire away from a perimeter of said aperture of said bottom panel of said guide track to help prevent short circuits which could occur if an uninsulated portion the first sensor wire came in contact with the guide track.

* * * * *